US010555601B1

(12) United States Patent
Oblak

(10) Patent No.: US 10,555,601 B1
(45) Date of Patent: Feb. 11, 2020

(54) EXPANDABLE TABLE ASSEMBLY

(71) Applicant: Theresa Oblak, N Vernon, IN (US)

(72) Inventor: Theresa Oblak, N Vernon, IN (US)

( * ) Notice: Subject to any disclaimer, the term of this patent is extended or adjusted under 35 U.S.C. 154(b) by 0 days.

(21) Appl. No.: 16/254,071

(22) Filed: Jan. 22, 2019

(51) Int. Cl.
*A47B 1/04* (2006.01)
*A47B 83/04* (2006.01)
*A47B 13/08* (2006.01)
*A47B 85/06* (2006.01)

(52) U.S. Cl.
CPC ..... *A47B 1/04* (2013.01); *A47B 13/081* (2013.01); *A47B 83/045* (2013.01); *A47B 85/06* (2013.01)

(58) Field of Classification Search
CPC ..... A47B 1/04; A47B 13/081; A47B 83/045; A47B 45/046; A47B 85/06
USPC ..... 108/7, 11, 25, 78, 14
See application file for complete search history.

(56) References Cited

U.S. PATENT DOCUMENTS 889,050 A * 5/1908 Saettler ..... A47B 13/16 108/25
2,522,202 A * 9/1950 Theis ..... A47B 1/056 108/142
2,750,243 A * 6/1956 Zielfeldt ..... A47B 3/0803 108/1
2,829,935 A * 4/1958 Colleau ..... A47B 17/02 108/3
2,852,325 A * 9/1958 Fosnaugh ..... A47B 1/02 108/63
3,259,082 A * 7/1966 Williams ..... A47B 1/04 108/152
4,400,951 A * 8/1983 Cherry ..... A47B 83/04 108/50.13
4,519,607 A 5/1985 Schill
4,572,081 A * 2/1986 Copeland ..... A47B 1/03 108/11
4,646,654 A * 3/1987 Sullivan ..... A47B 13/023 108/66
4,815,393 A * 3/1989 Pollak ..... A47B 1/04 108/65
4,922,835 A 5/1990 Van Vliet
5,101,736 A * 4/1992 Bommarito ..... A47B 21/02 108/10
5,197,393 A * 3/1993 Yeakle ..... A47B 9/10 108/10
5,513,578 A 5/1996 Tordson
6,000,343 A 12/1999 Laney
6,003,450 A 12/1999 Bruckner
6,209,463 B1 * 4/2001 Koharchik ..... A61G 13/0018 108/7

(Continued)

*Primary Examiner* — Jose V Chen

(57) ABSTRACT

An expandable table assembly includes a box that is positionable on a support surface to serve as a coffee table. A lid is hingedly coupled to the box for closing the box. A top surface of the lid is horizontally oriented when the lid is closed to serve as a table top. The top surface of the lid is oriented at an upwardly slanting angle when the lid is in the open position to serve as an angled work surface. A first extension panel is hingedly coupled to the first lateral side of the box and a second extension panel is hingedly coupled to the second lateral side of the box. Each of the first and second extensions panel extends away from the respective first and second lateral sides in a horizontal orientation when the first and second extension panels are positioned in a deployed position thereby increasing a surface area of a top of the box.

5 Claims, 7 Drawing Sheets

(56) References Cited

U.S. PATENT DOCUMENTS

| | | | | |
|---|---|---|---|---|
| 6,406,228 | B1 * | 6/2002 | Xiao | B23Q 11/08 108/7 |
| 7,201,108 | B2 | 4/2007 | Eusebi | |
| 7,677,678 | B2 * | 3/2010 | Mosel | A47B 9/20 108/7 |
| 8,096,244 | B1 | 1/2012 | Bockheim | |
| 8,689,705 | B2 | 4/2014 | Martin | |
| 2006/0000393 | A1 * | 1/2006 | Ka'ahumanu | A47B 13/12 108/25 |
| 2009/0050028 | A1 * | 2/2009 | Liao Fang | A47B 13/12 108/26 |
| 2016/0174700 | A1 * | 6/2016 | Brandenberg | A47B 47/04 5/93.1 |

* cited by examiner

EXPANDABLE TABLE ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to table devices and more particularly pertains to a new table device for storing objects and selectively facilitating an angled work surface.

BRIEF SUMMARY OF THE INVENTION

An embodiment of the disclosure meets the needs presented above by generally comprising a box that is positionable on a support surface to serve as a coffee table. A lid is hingedly coupled to the box for closing the box. A top surface of the lid is horizontally oriented when the lid is closed to serve as a table top. The top surface of the lid is oriented at an upwardly slanting angle when the lid is in the open position to serve as an angled work surface. A first extension panel is hingedly coupled to the first lateral side of the box and a second extension panel is hingedly coupled to the second lateral side of the box. Each of the first and second extensions panel extends away from the respective first and second lateral sides in a horizontal orientation when the first and second extension panels are positioned in a deployed position thereby increasing a surface area of a top of the box.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
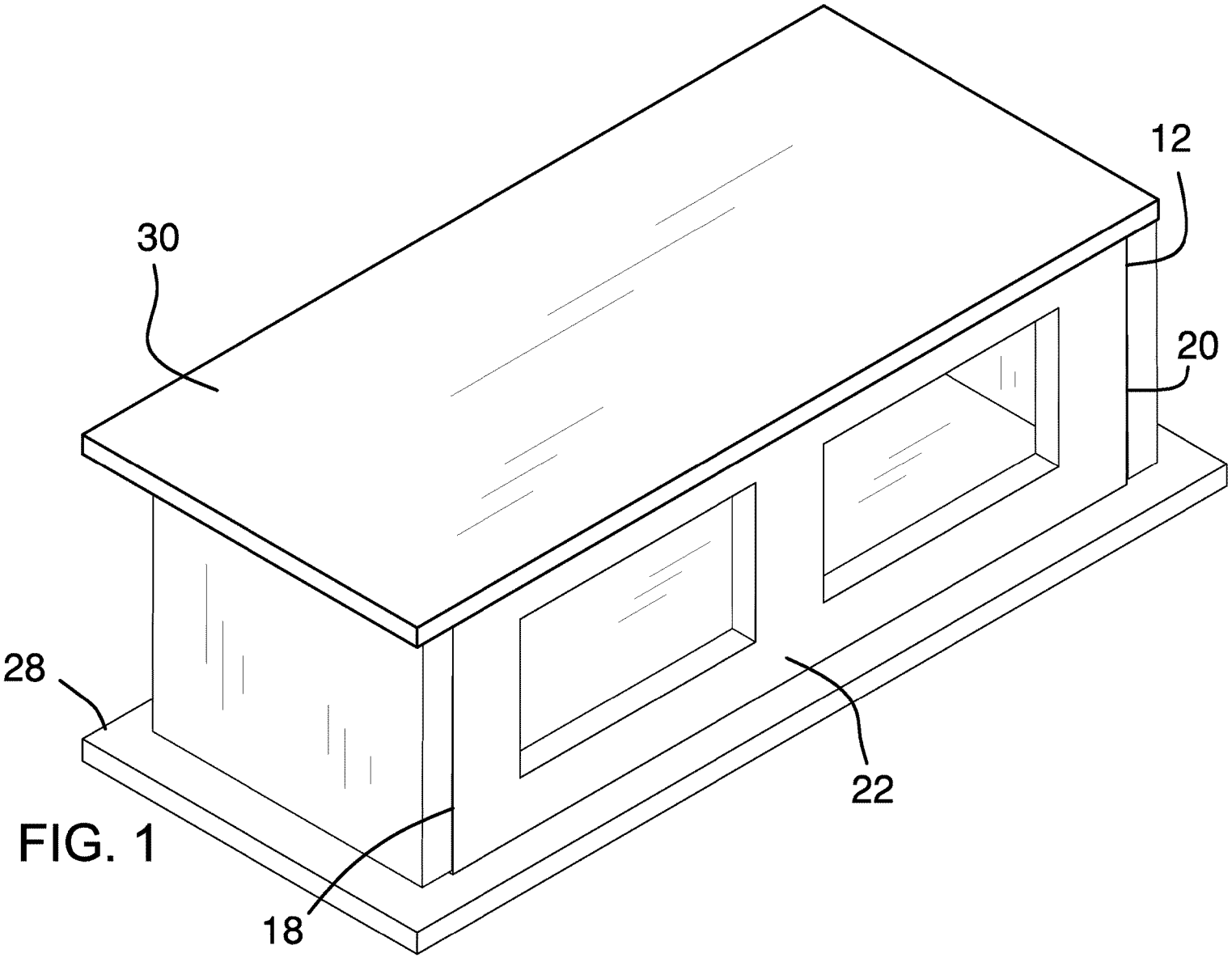
FIG. 1 is a top perspective view of an expandable table assembly according to an embodiment of the disclosure.
Figure 2:
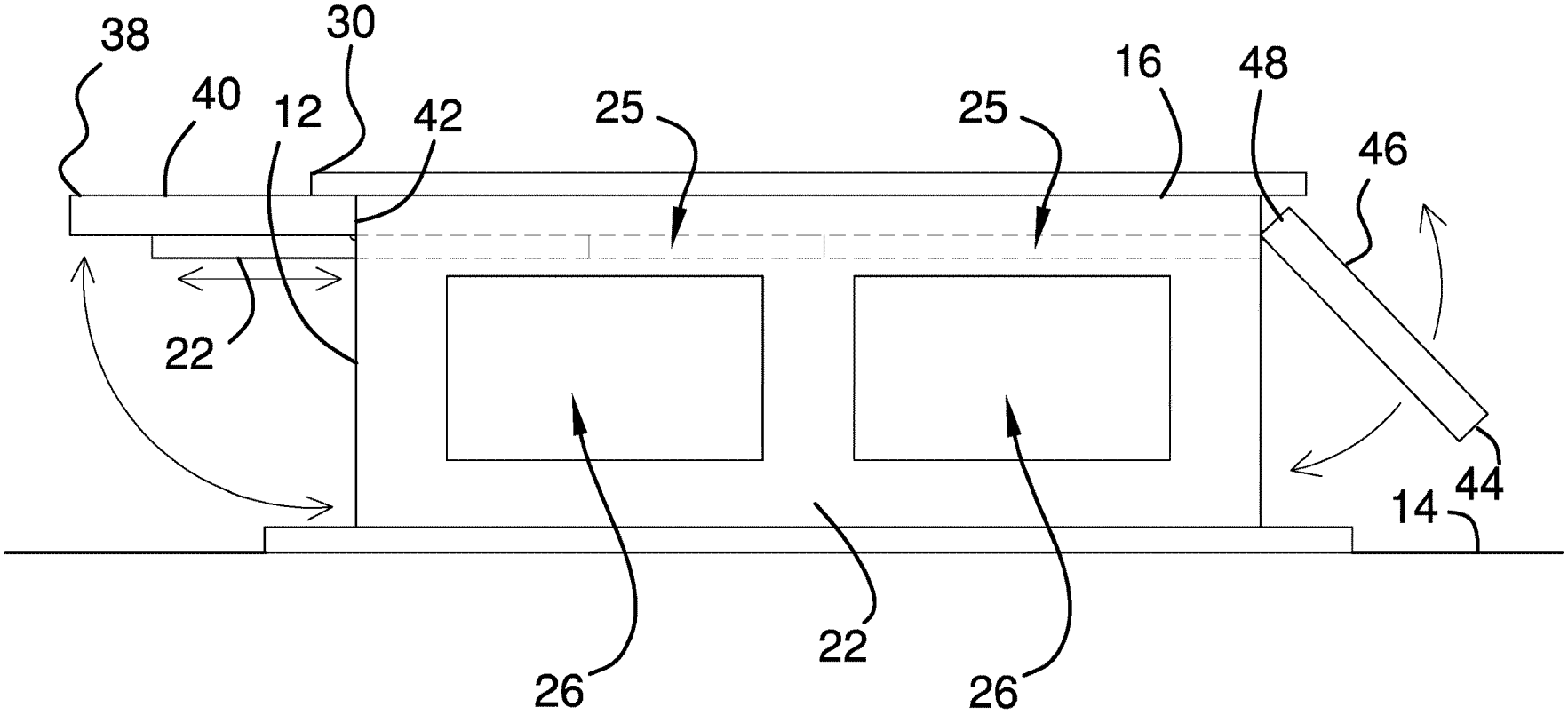
FIG. 2 is a front phantom view showing each of a first and a second extension panel of an embodiment of the disclosure being positioned into a deployed position.
Figure 3:
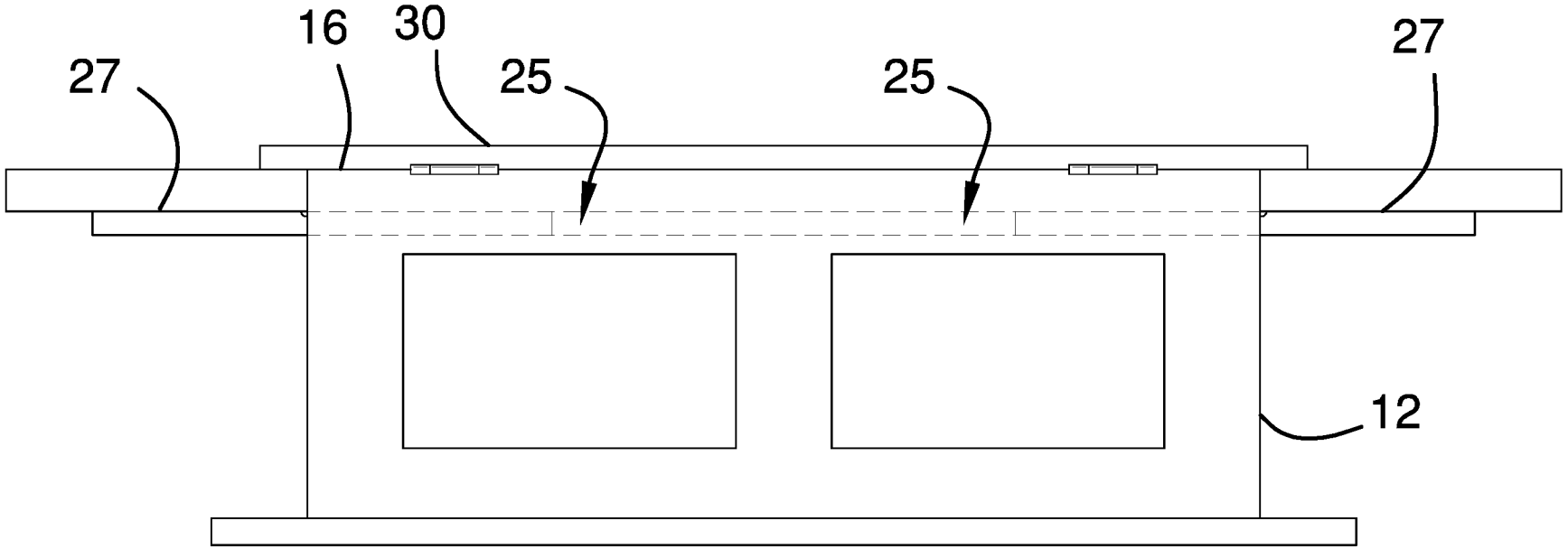
FIG. 3 is a back phantom view of an embodiment of the disclosure.
Figure 4:
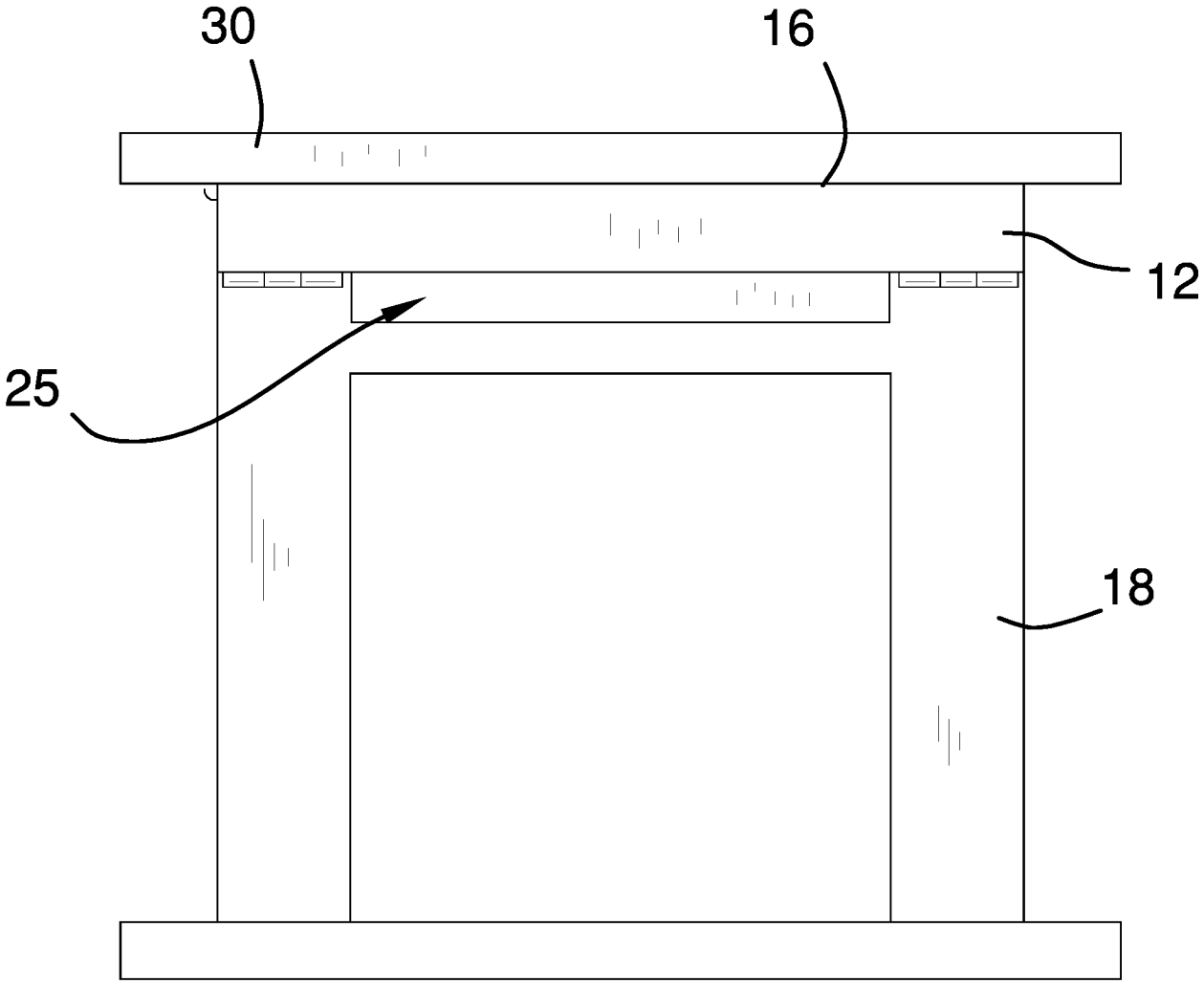
FIG. 4 is a right side view of an embodiment of the disclosure.
Figure 5:
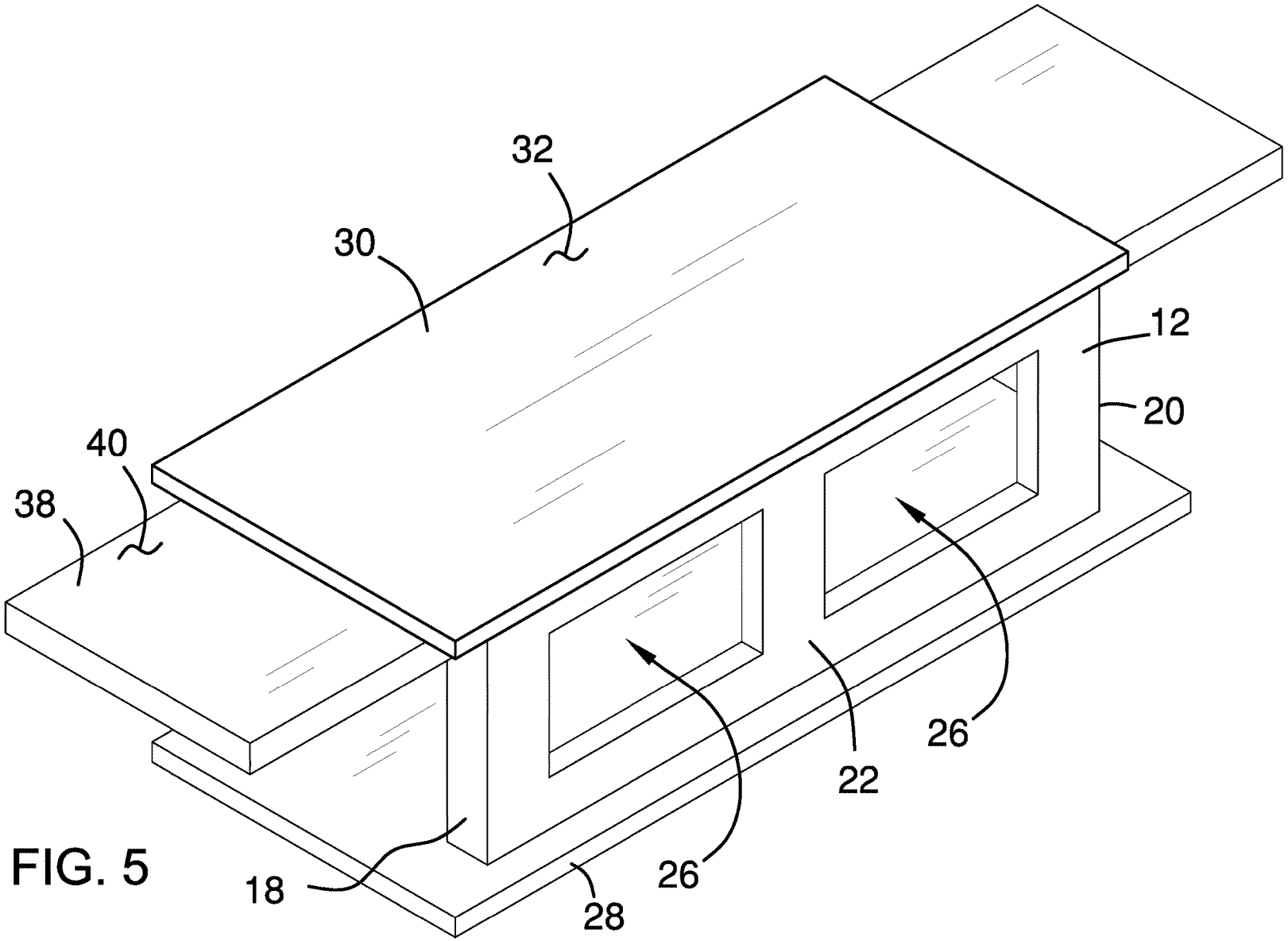
FIG. 5 is a top perspective view of an embodiment of the disclosure showing each of a first and second extension panel being positioned in a deployed position.
Figure 6:
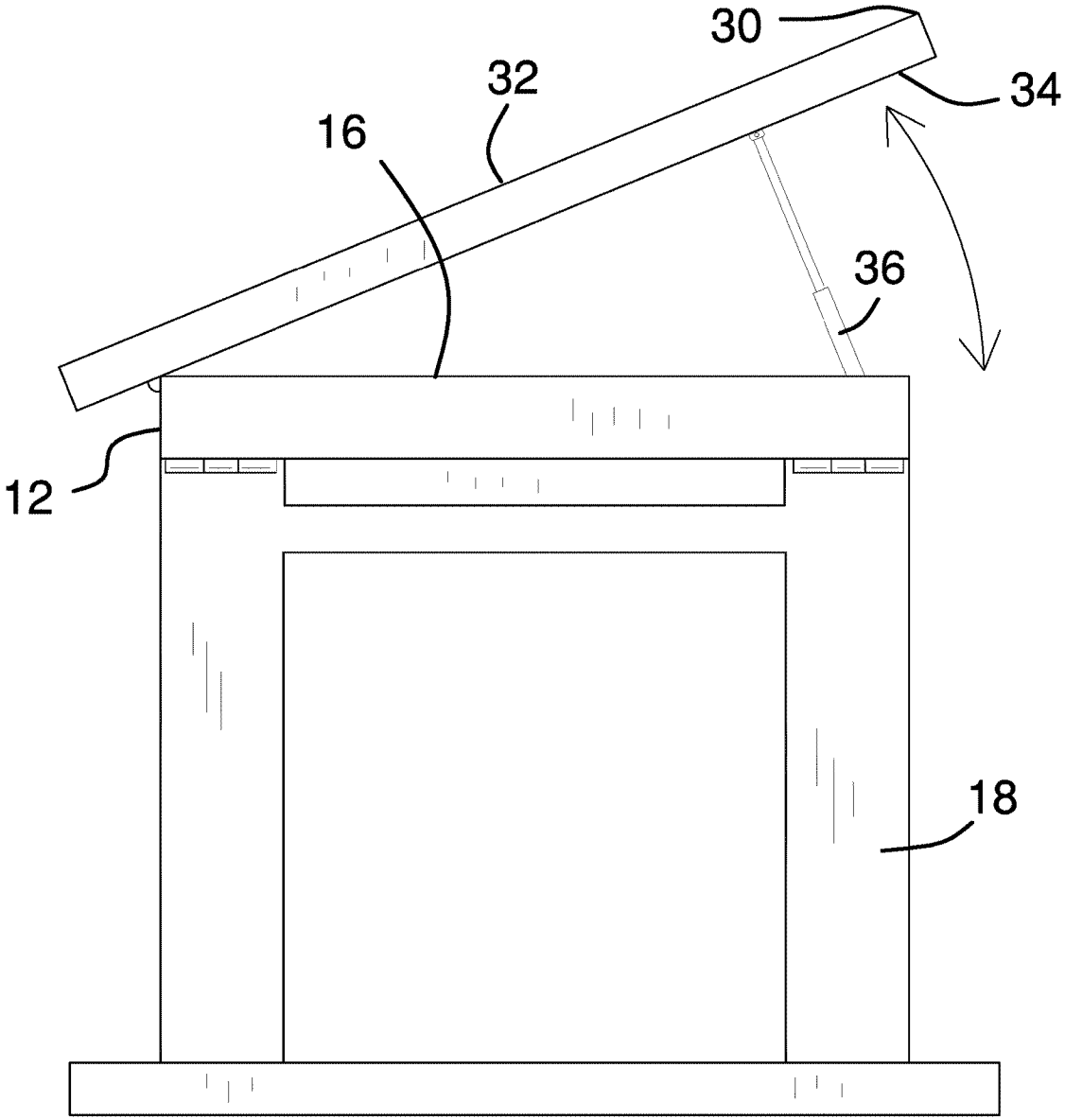
FIG. 6 is a right side view of an embodiment of the disclosure showing a lid being in an open position.
Figure 7:
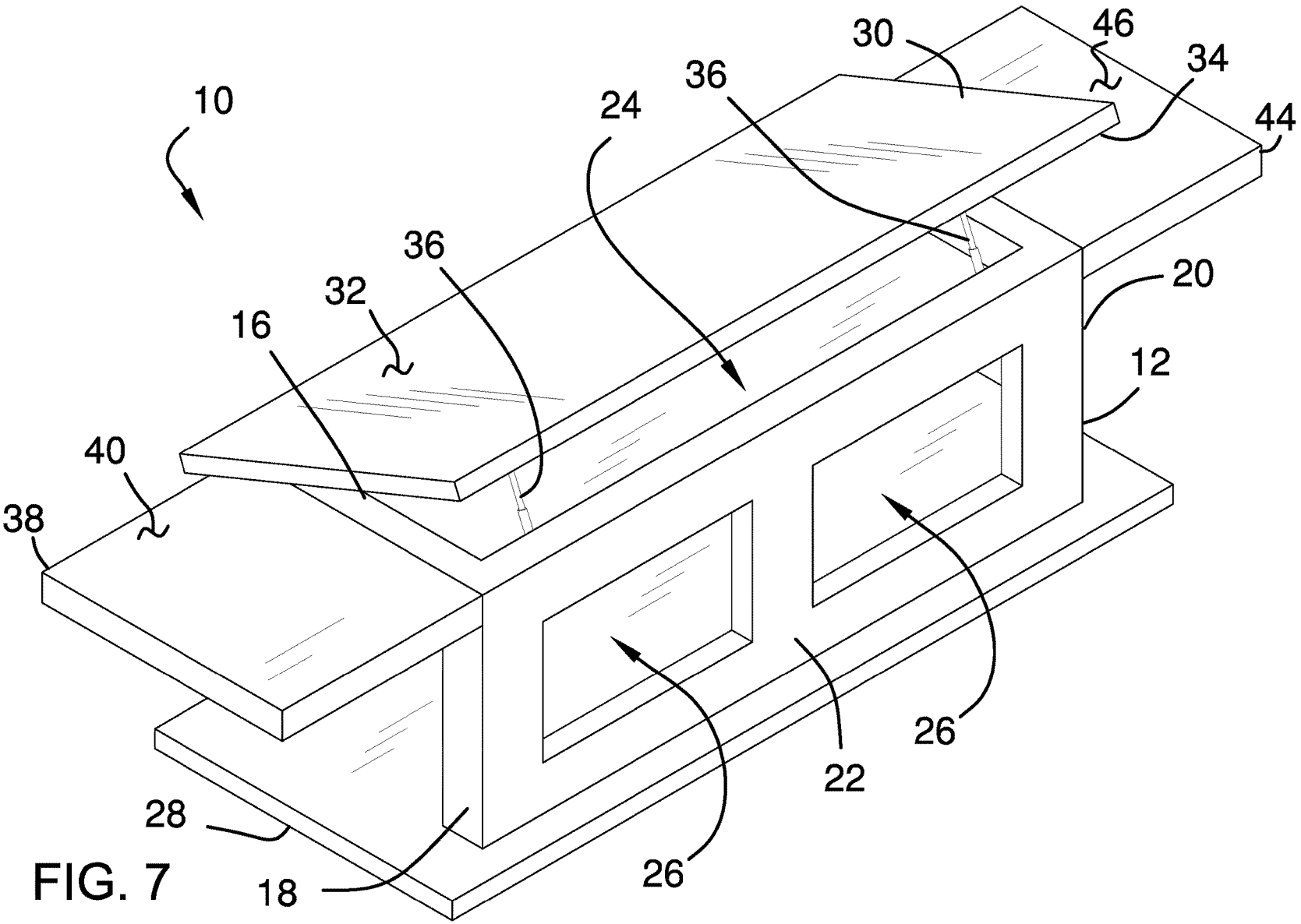
FIG. 7 is a top perspective view of an embodiment of the disclosure showing each of a first and second extension panel being positioned in a deployed position and showing a lid being positioned in an open position.

With reference now to the drawings, and in particular to FIGS. 1 through 7 thereof, a new table device embodying the principles and concepts of an embodiment of the disclosure and generally designated by the reference numeral 10 will be described.

As best illustrated in FIGS. 1 through 7, the expandable table assembly 10 generally comprises a box 12 that is positionable on a support surface 14, such as a floor in a living room or the like, to serve as a coffee table. The box 12 has a top side 16, a first lateral side 18, a second lateral side 20 and a front side 22. The top side 16 has an opening 24 extending an interior of the box 12 and the front side 22 has a pair of holes 26 each extending into the interior of the box 12. Additionally, each of the first 18 and second 20 lateral sides of the box 12 is open into the interior of the box. The interior of the box 12 can store magazines, board games and other objects that can easily be accessible through either of the holes 26 in the front side 22. Each of the first 18 and second 20 lateral sides of the box 12 has a respective storage slot 25 extending inwardly therein. A pair of supports 27 is each slidably positioned in the storage slot 24 in a respective one of the first 18 and second 20 lateral sides.

A base 28 is included and the box 12 is coupled on top of the base 28. The base 28 is positionable on the support surface 14 having the box 12 extending upwardly from the base 28. Moreover, the base 28 has a perimeter that is greater than a perimeter of the box 12 and the box 12 is centrally positioned on the base 28. A lid 30 is hingedly coupled to the box 12 for closing the box 12. A top surface 32 of the lid 30 is horizontally oriented when the lid 30 is closed thereby facilitating the top surface 32 to serve as a table top. The lid 30 has a bottom surface 34 and the bottom surface 34 lies on the top side 16 of the box 12 when the lid 30 is closed.

Moreover, the lid 30 angles upwardly from the top side 16 of the box 12 when the lid 30 is opened.

A pair of pistons 36 is included and each of the pistons 36 is coupled between the bottom surface 34 of the lid 30 and the top side 16 of the box 12. Each of the pistons 36 retains the lid 30 in the open position when the lid 30 is lifted into the open position. In this way the top surface 32 of the lid 30 is oriented at an upwardly slanting angle when the lid 30 is in the open position to serve as a work surface. Each of the pistons 36 may be pneumatic pistons or the like that have a pressure sufficient to support the weight of the lid 30 and a laptop computer or other common work objects.

A first extension panel 38 is hingedly coupled to the first lateral side 18 of the box 12. The first extension panel 38 extends away from the first lateral side 18 in a horizontal orientation when the first extension panel 38 is positioned in a deployed position. In this way the first extension panel 38 increases a surface area of a top of the box 12. The first extension panel 38 has an upper surface 40 and a first edge 42, and the first edge 42 is hingedly coupled to the first lateral side 18. The upper surface 40 lies on a plane that is coplanar with the top side 16 of the box 12 when the first extension panel 38 is in the deployed position. Additionally, the first extension panel 38 extends downwardly along the first lateral side 18 when the first extension panel 38 is in a stored position.

A second extension panel 44 is hingedly coupled to the second lateral side 20 of the box 12. The second extension panel 44 extends away from the second lateral side 20 in a horizontal orientation when the second extension panel 44 is positioned in a deployed position. In this way the second extension panel 44 increases a surface area of a top of the box 12. The second extension panel 44 has an upper surface 46 and a first edge 48, and the first edge 48 of the second extension panel 44 is hingedly coupled to the second lateral side 20. The upper surface 46 of the second extension panel 44 lies on a plane that is coplanar with the top side 16 of the box 12 when the second extension panel 44 is in the deployed position. Additionally, the second extension panel 44 extends downwardly along the second lateral side 20 when the second extension panel 44 is in a stored position.

In use, the box 12 is positioned in a living room or other room in a building to serve as a coffee table or the like. Any objects, such as magazines and board games, can be stored in the box 12 and can be easily accessible through either of the holes 26 in the front side 22 of the box 12. Each of the first 38 and second 44 extension panels can be positioned in the extended position to increase the surface area of the lid 30. The lid 30 can be positioned in the open position not only to access the interior of the box 12, but also to provide an inclined work surface. The support 27 in the slot 25 in the first lateral side 18 of the box 12 is slid outwardly beneath the first extension panel 38 to support the first extension panel 38 in the deployed position. Additionally, the support 27 in the slot 25 in the second lateral side 20 of the box 12 is slid outwardly beneath the second extension panel 44 to support the second extension panel 44.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An expandable table assembly being configured to increase a useable surface area without occupying more floor space, said assembly comprising:

a box being positionable on a support surface wherein said box is configured to serve as a coffee table;

a lid being hingedly coupled to said box for closing said box, a top surface of said lid being horizontally oriented when said lid is closed wherein said top surface is configured to serve as a table top, said top surface of said lid being oriented at an upwardly slanting angle when said lid is in said open position wherein said top surface is configured to serve as an angled work surface;

a first extension panel being hingedly coupled to said first lateral side of said box, said first extension panel extending away from said first lateral side in a horizontal orientation when said first extension panel is positioned in a deployed position for increasing a surface area of a top of said box; and a second extension panel being hingedly coupled to said second lateral side of said box, said second extension panel extending away from said second lateral side in a horizontal orientation when said second extension panel is positioned in a deployed position for increasing a surface area of a top of said box, said box having a top side, a first lateral side, a second lateral side and a front side, said top side having an opening extending an interior of said box, said front side having a pair of holes each extending into said interior of said box; and a base having said box being coupled thereto, said base being positionable on the support surface having said box extending upwardly from said base, said base having a perimeter being greater than a perimeter of said box, said box being centrally positioned on said base.

2. The assembly according to claim 1, further comprising:

said lid having a bottom surface, said bottom surface lying on said top side of said box when said lid is closed, said lid angling upwardly from said top side when said lid is opened;

a pair of pistons, each of said pistons being coupled between said bottom surface of said lid and said top side of said box, each of said pistons retaining said lid in said open position when said lid is lifted into said open position.

3. The assembly according to claim 1, wherein said first extension panel has an upper surface and a first edge, said first edge being hingedly coupled to said first lateral side of said box, said upper surface lying on a plane being coplanar with said top side of said box when said first extension panel is in said deployed position, said first extension panel extending downwardly along said first lateral side when said first extension panel is in a stored position.

4. The assembly according to claim 1, wherein said second extension panel has an upper surface and a first edge, said first edge of said second extension panel being hingedly coupled to said second lateral side, said upper surface lying on a plane being coplanar with said top side of said box when said second extension panel is in said deployed position, said second extension panel extending downwardly along said second lateral side when said second extension panel is in a stored position.

5. An expandable table assembly being configured to increase a useable surface area without occupying more floor space, said assembly comprising:

a box being positionable on a support surface wherein said box is configured to serve as a coffee table, said box having a top side, a first lateral side, a second lateral side and a front side, said top side having an opening extending an interior of said box, said front side having a pair of holes each extending into said interior of said box;

a base having said box being coupled thereto, said base being positionable on the support surface having said box extending upwardly from said base, said base having a perimeter being greater than a perimeter of said box, said box being centrally positioned on said base;

a lid being hingedly coupled to said box for closing said box, a top surface of said lid being horizontally oriented when said lid is closed wherein said top surface is configured to serve as a table top, said lid having a bottom surface, said bottom surface lying on said top side of said box when said lid is closed, said lid angling upwardly from said top side when said lid is opened;

a pair of pistons, each of said pistons being coupled between said bottom surface of said lid and said top side of said box, each of said pistons retaining said lid in said open position when said lid is lifted into said open position, said top surface of said lid being oriented at an upwardly slanting angle when said lid is in said open position wherein said top surface is configured to serve as an angled work surface;

a first extension panel being hingedly coupled to said first lateral side of said box, said first extension panel extending away from said first lateral side in a horizontal orientation when said first extension panel is positioned in a deployed position for increasing a surface area of a top of said box, said first extension panel having an upper surface and a first edge, said first edge being hingedly coupled to said first lateral side, said upper surface lying on a plane being coplanar with said top side of said box when said first extension panel is in said deployed position, said first extension panel extending downwardly along said first lateral side when said first extension panel is in a stored position; and a second extension panel being hingedly coupled to said second lateral side of said box, said second extension panel extending away from said second lateral side in a horizontal orientation when said second extension panel is positioned in a deployed position for increasing a surface area of a top of said box, said second extension panel having an upper surface and a first edge, said first edge of said second extension panel being hingedly coupled to said second lateral side, said upper surface lying on a plane being coplanar with said top side of said box when said second extension panel is in said deployed position, said second extension panel extending downwardly along said second lateral side when said second extension panel is in a stored position.

* * * * *